US008863337B2

(12) United States Patent
Haye et al.

(10) Patent No.: US 8,863,337 B2
(45) **Date of Patent: *Oct. 21, 2014**

(54) CHILD SLEEPING RESTRAINT

(71) Applicant: Jovan Pierre Haye, Brentwood, TN (US)

(72) Inventors: Jovan Pierre Haye, Brentwood, TN (US); Bruce Charles McLellan, Round Rock, TX (US)

(73) Assignee: Jovan Pierre Haye, Brentwood, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/910,113

(22) Filed: Jun. 4, 2013

(65) Prior Publication Data

US 2013/0340174 A1 Dec. 26, 2013

Related U.S. Application Data

(63) Continuation-in-part of application No. 13/004,216, filed on Jan. 11, 2011, now Pat. No. 8,549,685.

(51) Int. Cl.
*B68G 5/00* (2006.01)
*A47D 15/00* (2006.01)

(52) U.S. Cl.
CPC ..... *A47D 15/00* (2013.01); *A47D 15/005* (2013.01); *A47D 15/008* (2013.01)
USPC ..... 5/655; 5/655.9

(58) Field of Classification Search
USPC ..... 5/655, 424, 494, 636, 637; 128/869; 224/158
See application file for complete search history.

(56) References Cited

U.S. PATENT DOCUMENTS

| | | | | | |
|---|---|---|---|---|---|
| 3,672,364 | A * | 6/1972 | Rankin | 5/621 |
| 3,897,777 | A * | 8/1975 | Morrison | 5/622 |
| 4,034,748 | A * | 7/1977 | Winner | 602/19 |
| 4,528,981 | A * | 7/1985 | Behar | 5/637 |
| 5,159,727 | A * | 11/1992 | McCracken | 5/655 |
| 5,347,669 | A * | 9/1994 | Neviaser et al. | 5/655 |
| 5,632,052 | A * | 5/1997 | Michel | 5/655 |
| D389,359 | S * | 1/1998 | Nowak | D6/601 |
| 6,244,270 | B1 * | 6/2001 | Lutian et al. | 128/869 |
| 6,954,955 | B2 * | 10/2005 | Brewin et al. | 5/655 |
| 7,464,424 | B1 * | 12/2008 | Formica et al. | 5/655 |
| 8,302,230 | B1 * | 11/2012 | Jarrett et al. | 5/655 |
| 2005/0278854 | A1 * | 12/2005 | Taricani | 5/655 |
| 2008/0216244 | A1 * | 9/2008 | Minton | 5/640 |
| 2011/0107518 | A1 * | 5/2011 | Kelly et al. | 5/655 |

* cited by examiner

*Primary Examiner* — Robert G Santos
*Assistant Examiner* — Richard G Davis
(74) *Attorney, Agent, or Firm* — Shane V. Cortes

(57) ABSTRACT

The present invention relates to a sleeping restraint for a child that can be used to secure the child to the chest of an adult who is in a substantially horizontal position as well as to methods of using a sleeping restraint. In certain embodiments, the sleeping restraint comprises at least one chest strap for at least partially encircling the chest of an adult, first and second child restraining walls connected to the at least one chest strap, and a restraining strap connected to the chest strap for restraining a child in place on the adult's chest between the walls when the adult is lying on his back.

19 Claims, 9 Drawing Sheets

CHILD SLEEPING RESTRAINT

RELATED APPLICATIONS

This application is a continuation-in-part of U.S. patent application Ser. No. 13/004,216, filed Jan. 11, 2011, the contents of which are incorporated herein by reference in their entirety.

BACKGROUND

1. Technical Field

The present invention relates to a sleeping restraint for securing a child to the chest of an adult who is in a substantially horizontal position as well as to methods of using a sleeping restraint.

2. Background of the Invention

There are a variety of apparatuses for securing children to adult caregivers. Such apparatuses include, without limitation, BabyBjorn® Baby Carrier Original, BabyBjorn® Baby Carrier Air, BabyBjorn® Baby Carrier Active, BabyBjorn® Baby Carrier Synergy, and BabyBjorn® Comfort Carrier marketed by BabyBjorn® of Bersharma, Sweden and Performance and Sport ERGObaby® carriers marketed by ERGObaby® of Maui, Hi.

However, such apparatuses often are both cumbersome and designed to be worn by an adult who is in an upright position—e.g., an adult who is standing or walking.

BRIEF SUMMARY

In certain aspects, the present invention provides a sleeping restraint that can be used to secure a child to an adult who is lying on his/her back. In one embodiment, the sleeping restraint comprises at least one chest strap for at least partially encircling (i.e., partially or completely encircling) an adult's chest, first and second child restraining walls, and a first restraining strap.

In certain embodiments, the sleeping restraint includes one chest strap and the chest strap has first and second strap ends and has a length sufficient to completely encircle an adult's chest. The first and second child restraining walls are spaced along the length of the chest strap and preferably extend away from the chest strap such that when an adult is lying on the adult's back, the first and second child restraining walls are positioned on the anterior portion of the adult's chest, and the chest strap completely encircles the adult's chest, the walls extend generally upwards away from the adult's chest for a distance of at least about 2 inches, along the length of the adult's body for a distance of at least about 2 inches and along the length of the chest strap for a distance of at least about 2 inches. In certain embodiments, the sleeping restraint further comprises a connector for joining the first and second strap ends after the chest strap is placed around the adult's chest, as well as a base, which is attached to the chest strap and functions to receive a child.

In other embodiments, the sleeping restraint includes two chest straps that together with each other and a base completely encircle an adult's chest. In such embodiments, the first and second child restraining walls preferably are attached to different chest straps or the base. Preferably, the first and second child restraining walls are attached to the base. The first and second child restraining walls preferably extend from the chest strap(s) or base such that when an adult is lying on the adult's back, the first and second child restraining walls are positioned on the anterior portion of the adult's chest, and the chest straps at least partially encircle the adult's chest, the walls extend generally upwards away from the adult's chest for a distance of at least about 2 inches, along the length of the adult's body for a distance of at least about 2 inches and along the width of the adult's chest for a distance of at least about 2 inches.

The first restraining strap is connected to the at least one chest strap and functions to restrain a child in place on the adult's chest between the first and second child restraining walls when the adult is lying on the adult's back. Optionally, the first restraining strap is attached to the first child restraining wall. Optionally, the sleeping restraint comprises a second restraining strap connected to the at least one chest strap, and the second restraining strap releasably attaches to the first restraining strap so that the first restraining strap and the second restraining strap both function to restrain a child in place on the adult's chest between the first and second child restraining walls when the adult is lying on the adult's back.

In another embodiment, the invention provides a method for securing a child to an adult using the sleeping restraint. In certain aspects, the method includes:

a) at least partially encircling the at least one chest strap around the chest of the adult;

b) positioning the adult in a substantially horizontal position such that the adult is lying on the adult's back;

c) positioning the first and second child restraining walls on the anterior portion of the adult's chest such that the first and second child restraining walls extend vertically upward away from the adult's chest and longitudinally along the length of the adult; and d) positioning a child of about 3 years of age or younger between the first and second child restraining walls.

DETAILED DESCRIPTION

Figure 1:
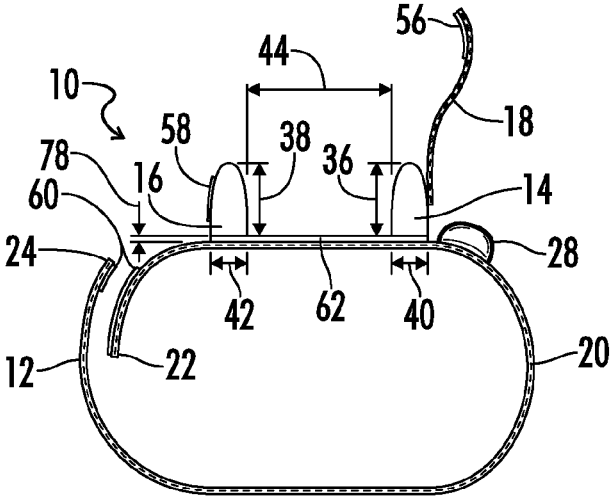
FIG. 1 illustrates a front, elevation view of a sleeping restraint in which the first and second strap ends of the chest strap have not been joined.

Referring now to the drawings, FIGS. 1-17 illustrate embodiments of a sleeping restraint generally designated by the numeral 10. In the drawings, not all reference numbers are included in each drawing for the sake of clarity. In addition, positional terms such as "height," "thickness," and "length" refer to the apparatus when in the orientation shown in the drawing.

Referring further to FIGS. 1-17, in some embodiments, the sleeping restraint 10 comprises a chest strap 12, first and second child restraining walls 14 and 16 and a first restraining strap 18. The chest strap 12 has a strap length 20 and first and second strap ends 22 and 24.

Figure 7:
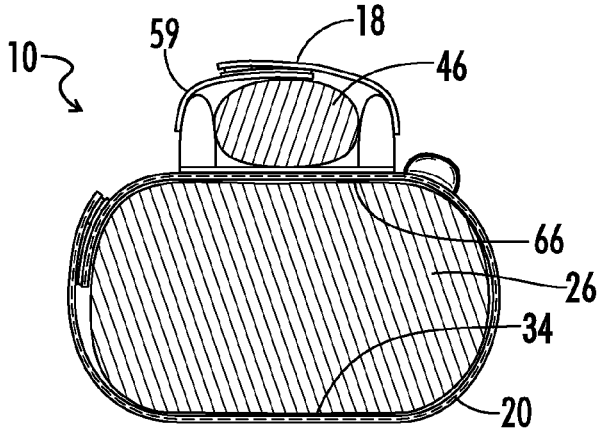
FIG. 7 illustrates a cross-sectional view of an adult who is lying on her back and using a sleep restraint to secure a child to the adult's chest.
Figure 8:
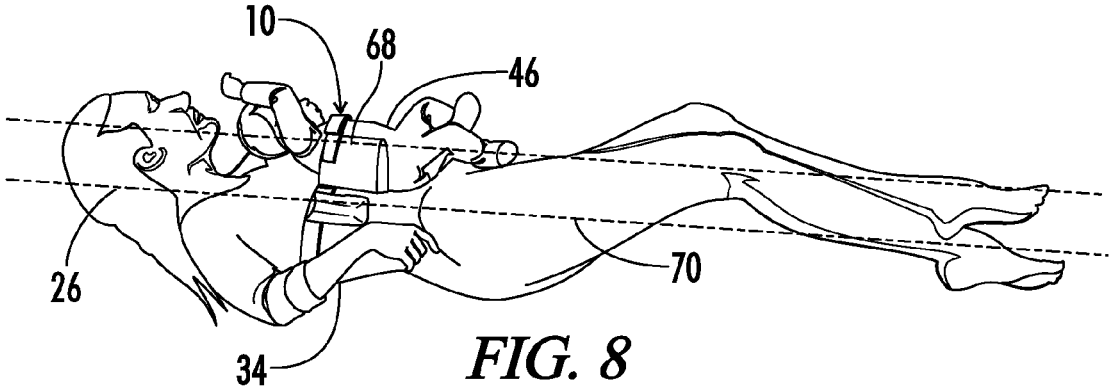
FIG. 8 illustrates a side view of an adult who is lying on her back and using a sleep restraint to secure a child to the adult's chest.

The chest strap 12 is positioned around the chest of an adult human 26 so that it partially or completely encircles the human's chest. For example, as shown in FIGS. 7 and 8 (which provide cross-sectional and side views of an adult 26 wearing the chest strap 12), in some embodiments, the strap length 20 is a sufficient length to completely encircle the chest of an adult human 26. As used herein, the terms "adult human" and "adult" mean a human of about 6 years of age or older. Further, the terms "completely encircled", "completely encircles" or "completely encircling", when used to refer to the chest strap 12, mean that the chest strap 12 forms a closed loop surrounding the chest of an adult human 26. Thus, in some embodiments, preferably the strap length 20 of the chest strap 12 is from about 25 inches to about 55 inches.

Figure 10:
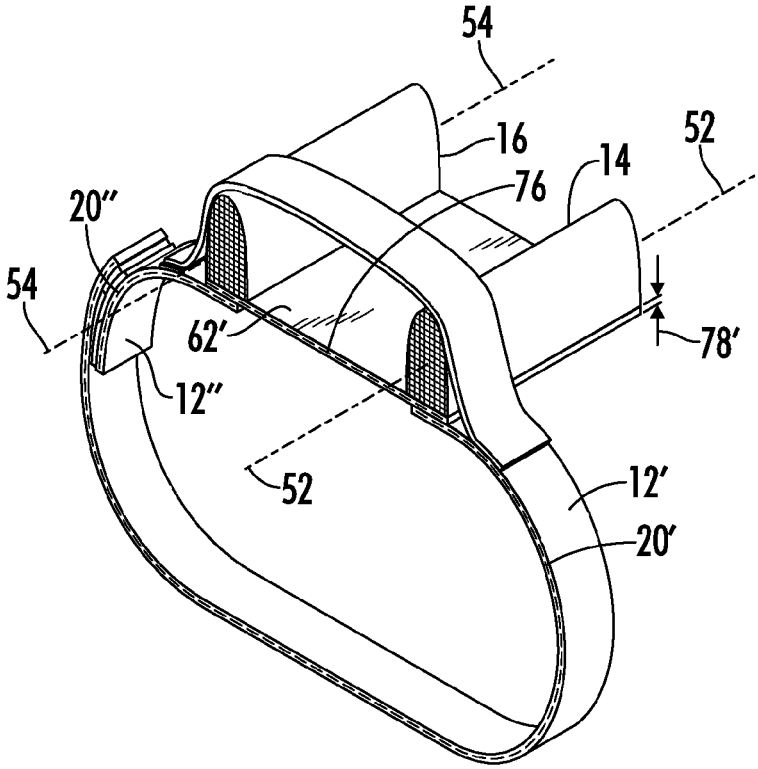
FIG. 10 illustrates a side, perspective view of a sleeping restraint that includes two chest straps, each of which is connected to a base and a first restraining strap.
Figure 11:
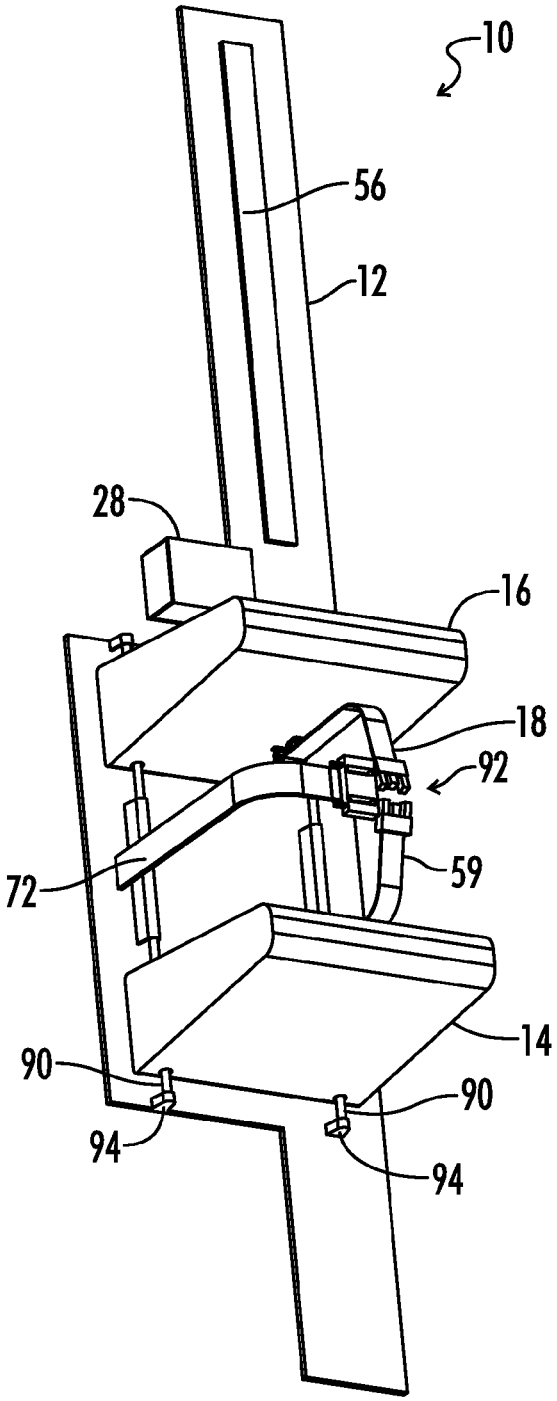
FIG. 11 illustrates a side, perspective view of a sleeping restraint with a three prong harness and fabric covering the first and second child restraining walls.
Figure 12:
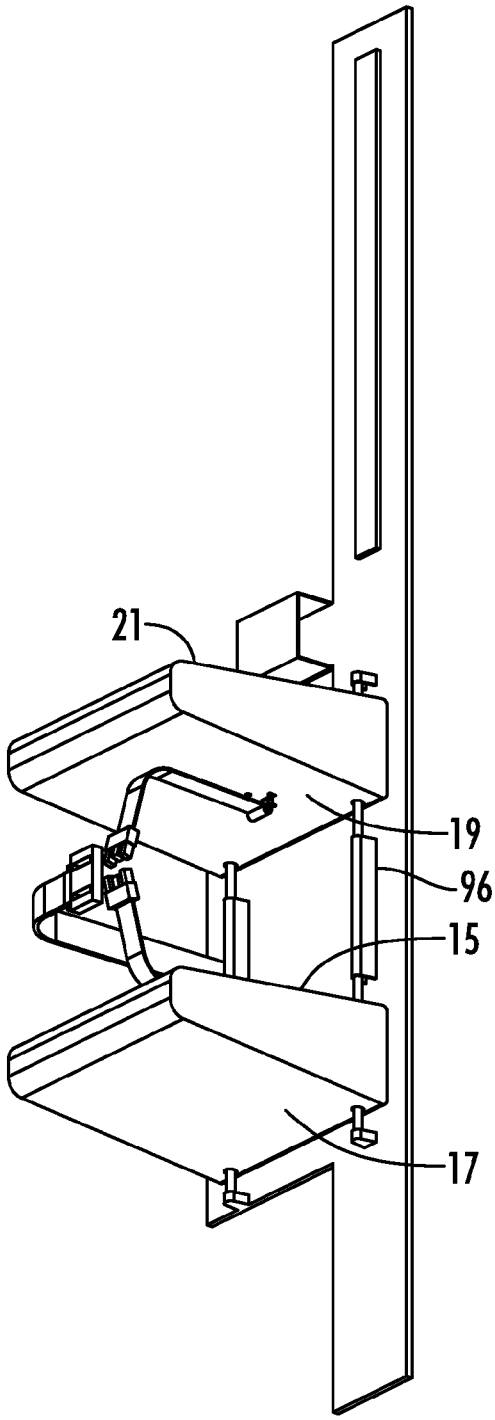
FIG. 12 is another side, perspective of the sleeping restraint of FIG. 11.
Figure 13:
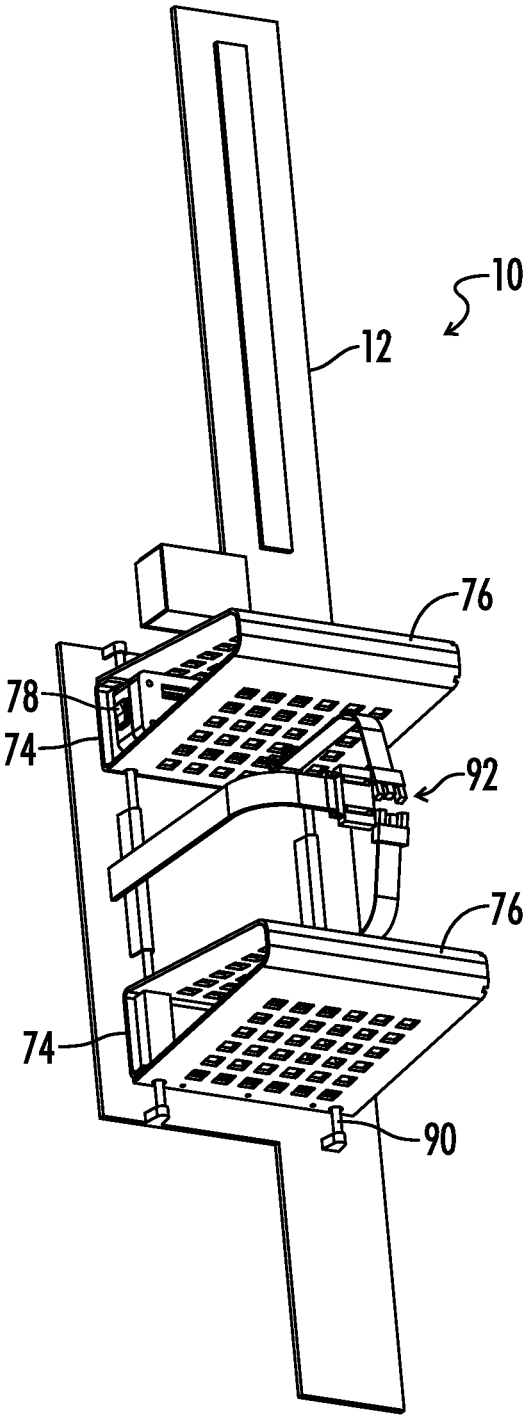
FIG. 13 is a side, perspective view of the sleeping restraint of FIG. 11 without any fabric covering the first and second child restraining walls.
Figure 14:
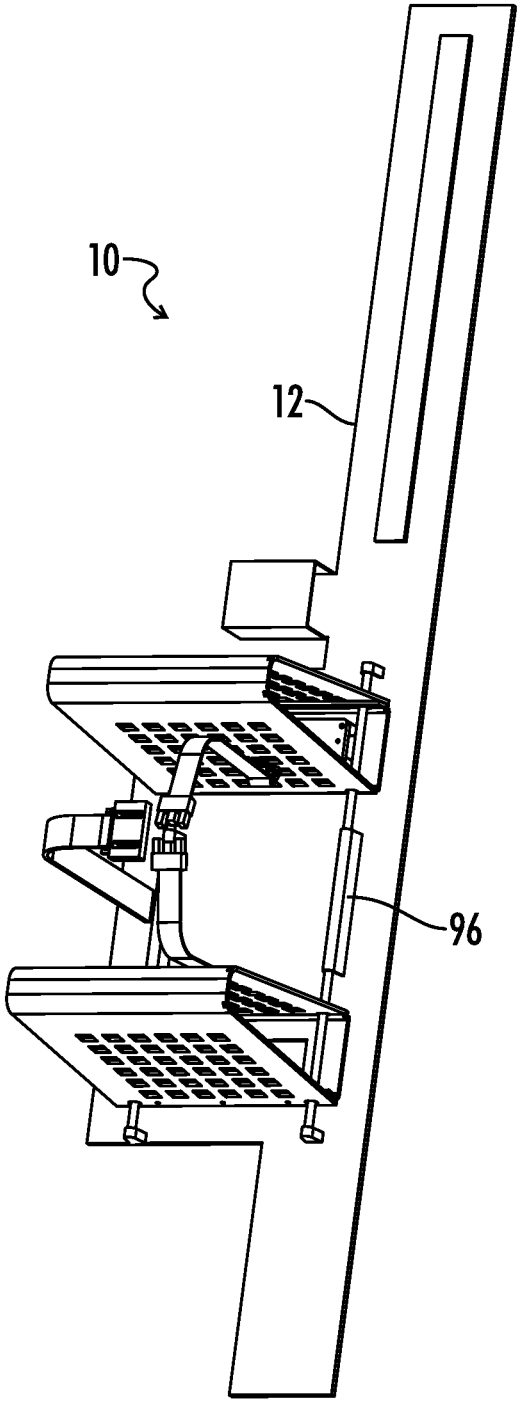
FIG. 14 is another side, perspective view of the sleeping restraint of FIG. 13.
Figure 15:
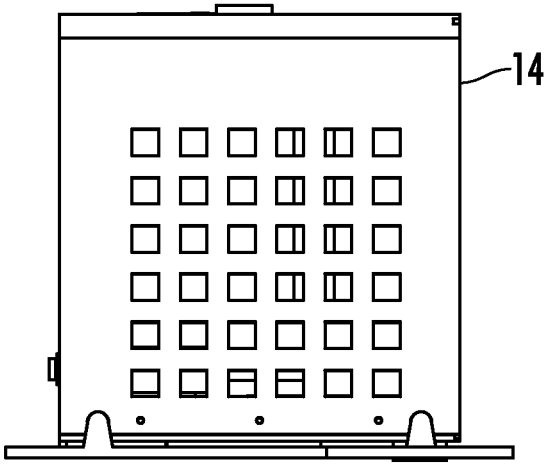
FIG. 15 is a side elevation view of the sleeping restraint of FIG. 14.
Figure 16:
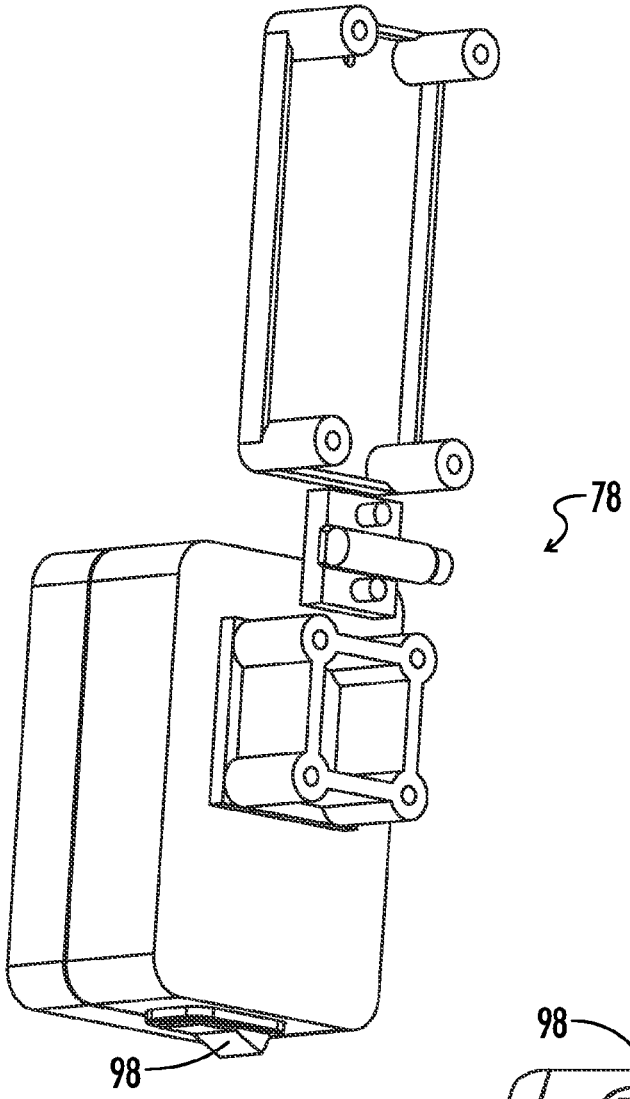
FIG. 16 is a side, perspective view of an alarm system for a sleeping restraint.
Figure 17:
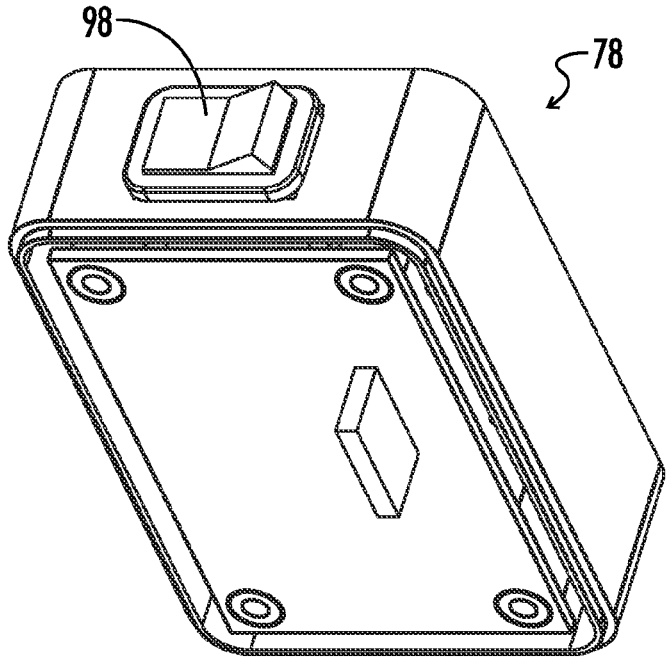
FIG. 17 is a bottom, perspective view of an alarm system for a sleeping restraint.
Figure 18:
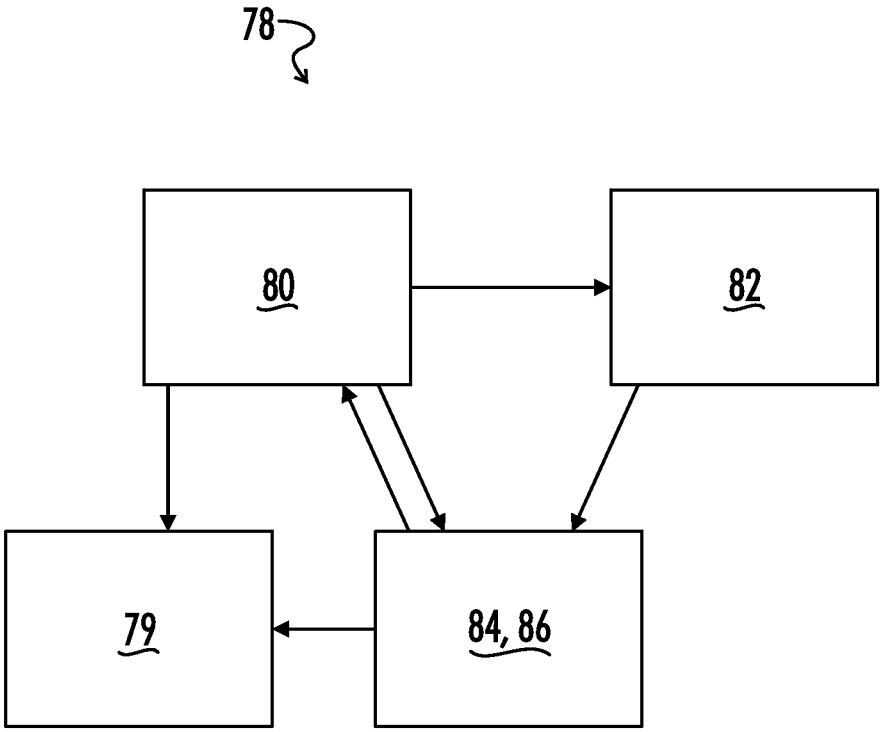
FIG. 18 is a schematic diagram of an accelerometer for a sleeping restraint.

In other embodiments, as shown in FIG. 10 and described in greater detail below, the sleeping restraint 10 includes two chest straps 12' and 12" and each chest strap only partially encircles the chest of an adult human 26.

Accordingly, the terms "encircled", "encircles", or "encircled" when used without the modifiers "partially" or "completely" to refer to a chest strap means the chest strap either partially or completely encircles the chest of an adult human 26.

Optionally, the chest strap 12 can further include a pocket 28, which can be used, for example, to hold a bottle, a pacifier, or a device that emits sounds such as a baby soother. The chest strap 12 can be comprised of any suitable material including, without limitation, fabric, leather, an elastic material, and nylon.

The sleeping restraint 10 further comprises first and second child restraining walls 14 and 16 connected to the chest strap 12. As shown in FIGS. 1 *and* 4, for example, the first and second child restraining walls 14 and 16 are spaced along the strap length 20 of the chest strap 12 and the first and second walls 14 and 16 each have a wall length 30 and 32 transverse to the strap length 20. The first and second child restraining walls 14 and 16 each include a wall base 74 (which is attached to the chest strap 14) and a peak 76 opposite the base. The first child restraining wall 14 further includes an interior side 15 facing the second child restraining wall 16 and an exterior side 17 opposite the interior side 15. The second child restraining wall 16 further includes an interior side 19 facing the first restraining wall 14 and an exterior side 21 opposite the interior side 19.

Preferably, the first and second child restraining walls 14 and 16 are dimensioned such that when i) an adult 26 is lying on the adult's back 34, ii) the first and second child restraining walls 14 and 16 are positioned on the anterior portion of the adult's chest and iii) the chest strap 12 at least partially encircles the adult's chest, the walls 14 and 16 extend:

i) generally upwards away from the adult's chest for a distance of at least about 2 inches, more preferably a distance of from about 2 inches to about 8 inches;

ii) along the length of the adult's body for a distance of at least about 2 inches, more preferably a distance of from about 2 inches to about 10 inches; and ii) along the width of the adult's chest for a distance of at least about 2 inches, more preferably a distance of from about 2 inches to about 4 inches.

The first and second child restraining walls 14 and 16 can be any shape. Thus, as used herein, when it is mentioned that the walls 14 and 16 extend along the width of the adult's chest for a distance of at least about 2 inches, it is meant that the maximum distance that each of the walls 14 and 16 extend along the width of the adult's chest is at least about 2 inches.

The sleeping restraint 10 may be worn by an adult of any size. However, when the orientation of the components (e.g., the walls 14 and 16) of the sleeping restraint 10 are provided herein with reference to an adult, the orientation should be determined with reference to an adult male having a chest size of 40 inches. For example, when it is said that the walls 14 and 16 extend generally upwards for a distance of at least about 2 inches when an adult 26 is lying on the adult's back 34, the first and second child restraining walls 14 and 16 are positioned on the anterior portion of the adult's chest and the chest strap 12 at least partially encircles the adult's chest, the "adult" referred to is an adult male having a chest size of 40 inches.

Figure 4:
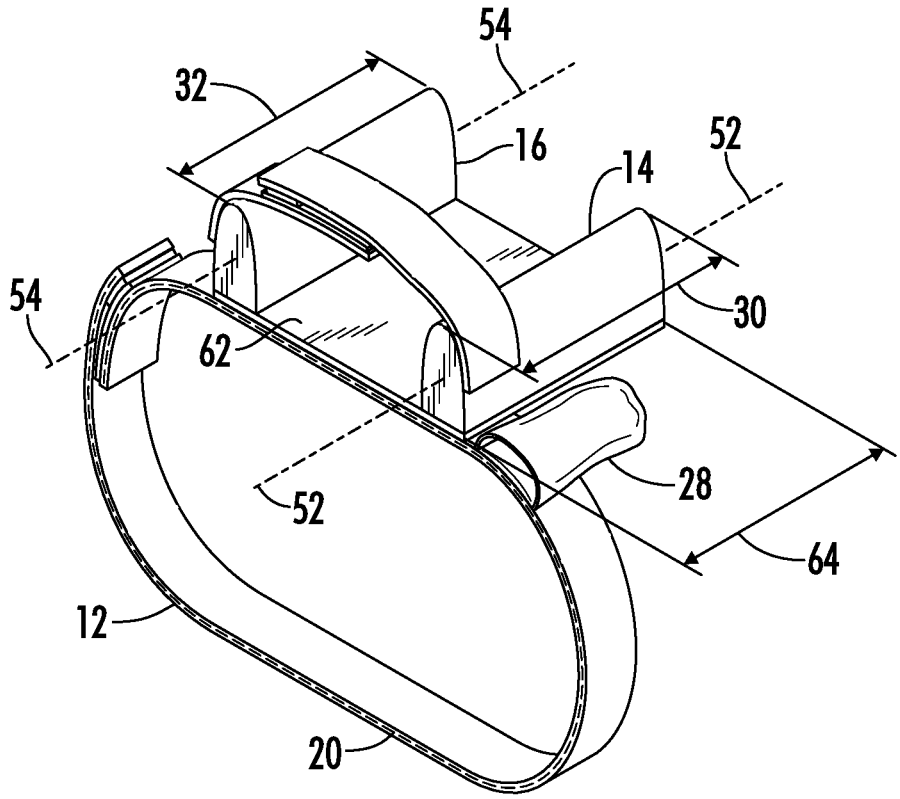
FIG. 4 illustrates a side, perspective view of a sleeping restraint that includes a base attached to the chest strap.

As shown in FIGS. 1 and 4, the first and second child restraining walls 14 and 16 each have a maximum height 36 and 38 of from about 2 inches to about 14 inches, a maximum thickness 40 and 42 of from about 2 inches to about 4 inches, and a wall length 30 and 32 of from about 2 inches to about 10 inches. In some embodiments, the first and second child restraining walls 14 and 16 each have a maximum height 36 and 38 of at least about 8 inches, measured from their bases 74 to their peaks 76.

As shown in FIGS. 1, 7 and 8, the average (mean) distance 44 between the first and second child restraining walls 14 and 16 is sufficient to allow a child 46 to lie lengthwise along the wall lengths 30 and 32 of the first and second child restraining walls 14 and 16.

As used herein, the terms "child" and "children" mean a human of less than about 6 years of age. Preferably, the sleeping restraint 10 allows a child of about 3 years of age or younger to lie lengthwise along the wall lengths 30 and 32 of the first and second child restraining walls 14 and 16. In an especially preferred embodiment, the child is about 1 year of age or younger. It will be appreciated that the distance between the walls 14 and 16 may vary along the wall lengths 30 and 32 and along the heights 36 and 38 of the walls 14 and 16. Preferably, the average (mean) distance 44 between the first and second child restraining walls 14 and 16 is from about 6 inches to about 14 inches.

Figure 6:
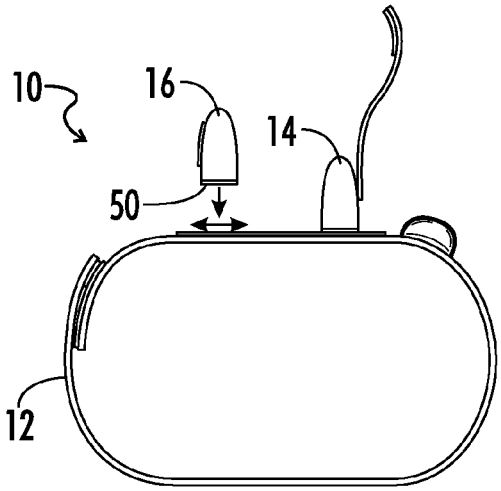
FIG. 6 illustrates a front, elevation view of a sleeping restraint in which the second child restraining wall is detached from the chest strap.

In certain embodiments, the average distance 44 between the first and second child restraining walls 14 and 16 is adjustable. For example, as shown in FIG. 6, in one embodiment, optionally, at least one of the first and second child restraining walls 14 and 16 are releasably attached to the chest strap 12 by a fastener 50 such as velcro, a magnet, a button, a buckle, and/or a snap, such that the position of at least one of the first and second child restraining walls 14 and 16 along the strap length 20 of the chest strap 12 is adjustable. Preferably, the fastener 50 is a snap. Preferably, one of the first and second child restraining walls 14 and 16 is permanently attached to the chest strap 12. In yet another, embodiment, the size of at least one of the first and second child restraining walls 14 and 16, and hence the average distance 44 between the first and second child restraining walls 14 and 16 is adjusted by filling at least one of the first and second child restraining walls 14 and 16 with air or releasing air from at least one of the first and second child restraining walls 14 and 16. In yet another embodiment, the sleeping restraint further includes a threaded rod 90 that is placed through the first and second child restraining walls 14 and 16 and the average distance 44 between the first and second child restraining walls 14 and 16 is adjusted by twisting knobs 94 connected to the rod 90. In some embodiments, the rod 90 is fully or partially covered by fabric 96 (e.g., a fabric sleeve) to provide cushion.

The first and second restraining walls 14 and 16 can be any shape. Preferably, the first and second restraining walls 14 and 16 are generally cylindrical, as shown in FIGS. 1-10. If the first and second child restraining walls 14 and 16 are generally cylindrical, it is also preferred that the longitudinal axes 52 and 54 of the restraining walls 14 and 16 are transverse to the strap length 20 of the chest strap 12 and parallel to the longitudinal axis of the adult 26 when the adult 26 is lying on the adult's back.

The first and second child restraining walls 14 and 16 can be formed from any material. For example, in one embodiment, the first and second child restraining walls 14 and 16 are formed from a compressible material, such as foam. In another embodiment, the first and second child restraining walls 14 and 16 are comprised of fabric. In certain embodiments, the first and second child restraining walls 14 and 16 are reinforced with steel, aluminum, plastic and/or wood. Preferably, the first and second child restraining walls 14 and 16 compress slightly but maintain substantially their original shape when a child is placed between the first and second child restraining walls 14 and 16.

In certain embodiments, the first and second child restraining walls 14 and 16 are substantially hollow. In one embodiment, the walls 14 and 16 are comprised of a plastic, substantially hollow frame 88 that is covered with fabric. Preferably, if the first and second child restraining walls 14 and 16 are substantially hollow, one or more surfaces of the first and second child restraining walls 14 and 16 is comprised of a mesh material. For example, in FIGS. 9 and 10, the opposing ends 14*a*, 14*b*, 16*a*, and 16*d* of the walls 14 and 16 at each end of the wall lengths 30 and 32 are comprised of a mesh material. Without being bound to any particular theory, it is believed that the combination of having substantially hollow first and second child restraining walls 14 and 16 and end surfaces 14*a*, 14*b*, 16*a* and 16*b* comprised of mesh material may make it easier for a child to breath when the child is positioned between the walls 14 and 16.

Figure 2:
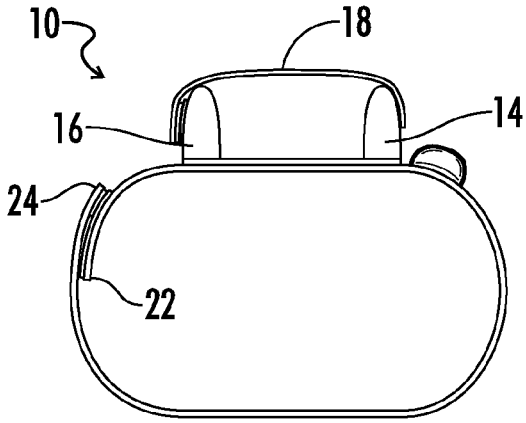
FIG. 2 illustrates a front, elevation view of a sleeping restraint in which the first and second strap ends have been joined by a connector and the first restraining strap is attached to the first and second child restraining walls.
Figure 3:
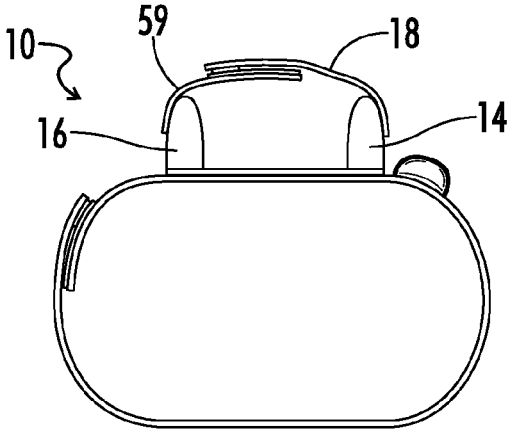
FIG. 3 illustrates a front, elevation view of a sleeping restraint in which the first and second strap ends have been joined by a connector and the first restraining strap is attached to the second restraining strap.

The sleeping restraint 10 further comprises at least one restraining strap connected to the chest strap 12 for restraining a child 46 in place on the adult's chest between the walls 14 and 16 when the adult 26 is lying on the adult's back 34. For example, in certain embodiments, as shown in FIGS. 1, 2, 6, and 10, the sleeping restraint 10 includes one restraining strap 18 and the restraining strap 18 is configured to span at least from the first child restraining wall 14 to the second child restraining wall 16. In certain embodiments, the restraining strap 18 is attached to the first child restraining wall 14, as shown in FIGS. 1, 2, and 6. Preferably, the restraining strap 18 is attached to the interior side 15 of the first restraining wall 14. In other embodiments, the restraining strap 18 is attached to the chest strap 12, 12' or 12", as shown in FIG. 10. In one embodiment, the first restraining strap 18 releasably attaches to the second child restraining wall 16. For example, as shown in FIG. 2, the first restraining strap 18 can releasably attach to the second child restraining wall 16 through the use of a fastener, such as velcro, a magnet, a button, a buckle, and/or a snap, positioned on the restraining strap 18 and/or the second child restraining wall 16. In a preferred embodiment, a velcro pad 56 is attached to the restraining strap 18 and a mating velcro pad 58 is attached to the second child restraining wall 16. In another preferred embodiment, a snap is used to attach the restraining strap 18 to the second child restraining wall 16.

Figure 9:
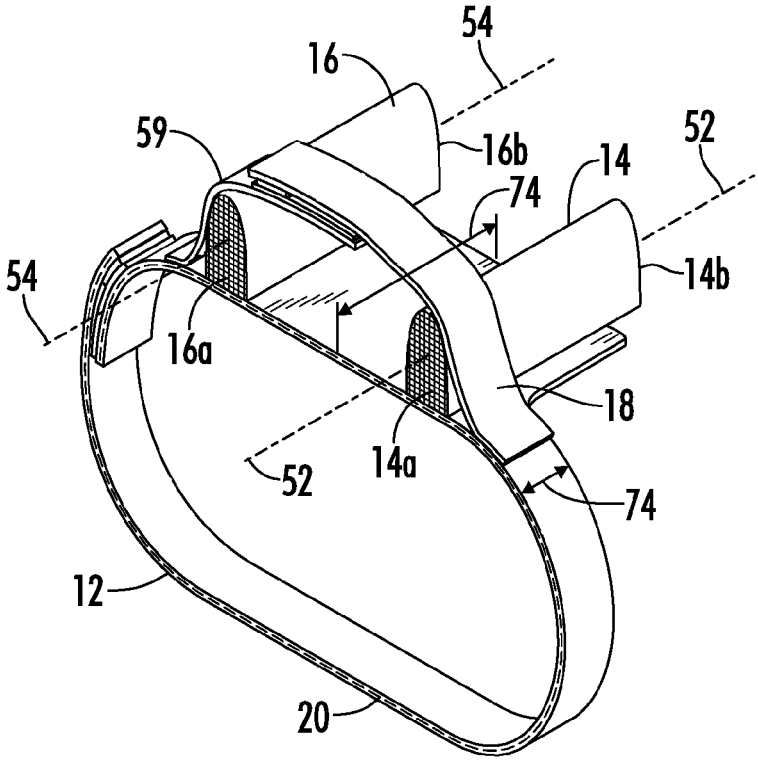
FIG. 9 illustrates a side, perspective view of a sleeping restraint without a base wherein the chest strap has a variable width and the first and second restraining straps are attached to the chest strap.

In yet another embodiment, as shown in FIGS. 3-5, 7 and 9, the sleeping restraint 10 includes a second restraining strap 59 in addition to the first restraining strap 18. In such an embodiment, both of the restraining straps 18 and 59 are connected to the chest strap 12 or 12' and 12" and are configured so that when the restraining straps 18 and 59 are attached to one another, the attached restraining straps 18 and 59 span at least from the first child restraining wall 14 to the second child restraining wall 16, as shown in FIGS. 3-5, 7 and 9. In one embodiment, the second restraining strap 59 is attached to the second child restraining wall 16, as shown in FIGS. 3-5 and 7. Preferably, the second restraining strap 59 is attached to the interior side 19 of the second child restraining wall 16. In yet another embodiment, the second restraining strap 59 is attached to the chest strap 12, 12' or 12", as shown in FIG. 9. In such embodiments, the first and second restraining straps 18 and 59 releasably attach to each other through, for example, the use of a fastener, such as velcro, a magnet, a button, a buckle, and/or a snap, positioned on the first restraining strap 18 and/or the second restraining strap 59. In some embodiments, the sleeping restraint 10 includes a three prong harness 92, and the first prong of the harness 92 includes the first restraining strap 18, the second prong of the harness 92 includes the second restraining strap 59, and the third prong of the harness 92 includes a third restraining strap 72 attached to the chest strap 12. In some embodiments, the three prong harness 92 uses a buckle system.

Preferably, the first restraining strap 18 is attached to the first child restraining wall 14 closer to the base 74 than the peak 76 of the wall 14—i.e., less than halfway up the wall height 36. Similarly, preferably, the second restraining strap 59 is attached to the second restraining wall 16 closer to the base 74 than the peak 76 of the wall 16. Without being bound by any particular theory, it is believed that having wall heights 36 and 38 of at least 8 inches and attaching the first and second restraining straps 18 and 59 as described in this paragraph will prevent a child 46 from being crushed if an adult 26 wearing the sleeping restraint were to roll over because the peaks 76 would touch the surface (e.g., a bed) and bear the load and the child 46 would be suspended below the peaks 76. In some embodiments, the peak 76 of the first restraining wall 14 and the peak 76 of the second restraining wall 16 are each configured to withstand a force of at least 500 Newtons. In such an embodiment, the peaks 76 are capable of withstanding the force exerted by gravity when an adult 26 weighing at least 225 pounds and wearing the restraint 10 rolls over and drives the peaks 76 into a surface such as a bed or the floor.

In some embodiments, in addition to or in place of the safety features described in the immediately preceding paragraph, the sleeping restraint further includes an alarm system 78, which includes a power source (e.g., a battery) 80 configured to power the alarm system 78, an alarm 79 (e.g., a vibrator or audible noise), a memory 84, a sensor 82 configured to determine the orientation of the sleeping restraint 84 and a processor 86 configured to trigger the alarm 79 when the sensor 82 senses that the sleeping restraint 10 occupies a dangerous orientation. For example, in some embodiments, the sleeping restraint 10 the sensor 82 is an accelerometer that is configured to determine the x, y and z orientation of the sleeping restraint 10 with the zero of the sensor 82 set to the walls 14 and 16 being perpendicular to the Earth with the peaks 76 above the bases 74 and the alarm 79 is triggered when the peaks 76 move predetermined point from the zero to alert the adult 26 that he is rolling over. In some embodiments, the alarm system 78 is provided in the interior of the first and/or second restraining walls 14, 16. Optionally, the alarm system 78 is powered on by a button 98. In one particular embodiment, the accelerometer is the MMA 7361L accelerometer (Freescale Semiconductor, Inc., Austin Tex.) and the processor 86 is the PIC16F690IP CPU (Microchip Technology, Inc., Chandler Ariz.). However, it will be appreciated that the aforementioned accelerometer and processors are merely exemplary and other suitable accelerometers and processors may be used. Optionally, the accelerometer has at least 1.5 G sensitivity. In some embodiments, the processor 86 measures voltages emitted by the accelerometer.

Figure 5:
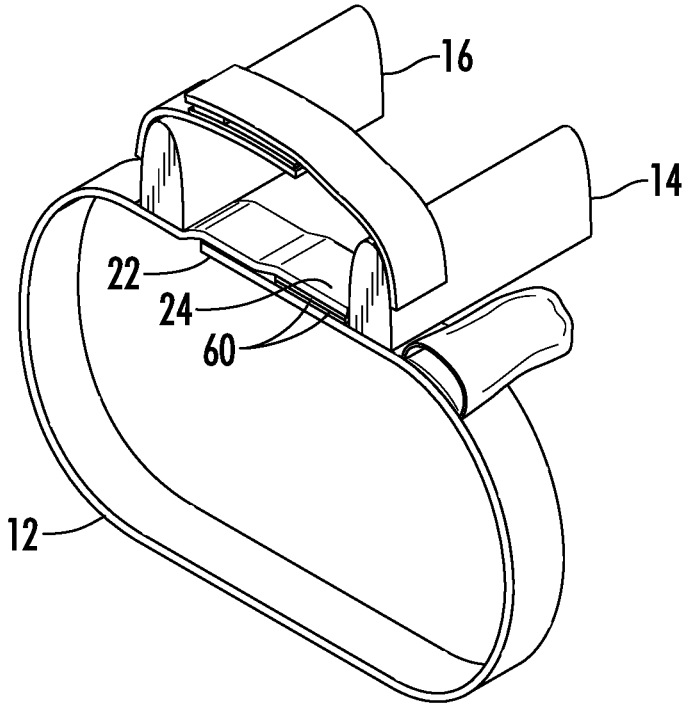
FIG. 5 illustrates a side, perspective view of a sleeping restraint that does not include a base attached to the chest strap.

Optionally, the sleeping restraint 10 further includes a connector 60 for joining the first and second strap ends 22 and 24 together after the chest strap 12 is placed around the adult's chest. The connector 60 can be any article or articles suitable for joining the first and second strap ends 22 and 24. For example, the connector 60 can be a fastener, such as velcro, a magnet, a button, a buckle, and/or a snap. Preferably, the connector 60 is attached to the chest strap 12 and the connector 60 comprises mating velcro pads that are attached to the chest strap 12. Optionally, as shown in FIG. 5, the first and second strap ends 22 and 24 can join between the first and second child restraining walls 14 and 16.

The sleeping restraint 10 optionally further includes a base 62 for receiving a child 46, as shown in FIGS. 1-4 and 6-7. In certain embodiments, the base 62 is attached to the chest strap 12 and the base 62 has a base length 64 transverse to the strap length 20. Preferably, in such an embodiment, the first and second child restraining walls 14 and 16 are attached to the base 62 so that when the adult 26 is lying on the adult's back 34, the first and second child restraining walls 14 and 16 extend generally upward away from the adult's chest and along the base 62 transverse to the strap length 20. It is also preferred in this embodiment that the base 62 separates the first and second child restraining walls 14 and 16 from the chest strap 20.

In other embodiments, as shown in FIG. 10, the sleeping restraint 10 includes a base 62' and two chest straps 12' and 12", which each have strap lengths 20' and 20" and are attached to the base 62'. In such an embodiment, the base 62' has a base width 76 that extends along width of the adult's chest when the adult 26 is lying on the adult's back and the first and second restraining walls 14 and 16 are positioned on the anterior portion of the adult's chest. Preferably, the combined length of the base width 76 and the strap lengths 20' and 20" is sufficient to completely encircle the chest of the adult. For example, the base width 76 and strap lengths 20' and 20" may have a combined length of from about 25 inches to about 70 inches. Preferably, the chest straps 12' and 12" releasably attach to each other through, for example, the use of a fastener, such as velcro, a magnet, a button, a buckle, and/or a snap, positioned on either or both of the chest straps 12' and 12". In such an embodiment, preferably, the first and second child restraining walls 14 and 16 are attached to the base 62', as shown in FIG. 10. Alternatively, the first child restraining wall 14 may be attached to the first chest strap 12' and the second child restraining wall 16 may be attached to the second chest strap 12". Aside from the length of the chest straps 12' and 12", the components of the sleeping restraint 10 in this embodiment are the same as described previously. For example, the first and second child restraining walls 14 and 16 are comprised of the same material described previously (e.g., fabric, steel, aluminum, plastic and/or wood) and have the dimensions previously described. In addition, the sleeping restraint 10 further includes one or more restraining straps as described above.

The bases 62 and 62' can any shape or size. Preferably, the base 62 or 62' extends at least about 10 inches (e.g., about 10 to about 18 inches) along the width of the adult's chest, and at least about 6 inches (e.g., about 6 inches to about 12 inches) along the length of the adult's body when the adult is lying on the adult's back, the chest straps 12 or 12' and 12" are placed around the adult's chest and the first and second child restraining walls 14 and 16 are positioned on the anterior portion of the adult's chest. The base 62 and 62' can be any suitable height 78 or 78' (e.g., from about 0.1 inch to about 1 inch). As the first and second child restraining walls 14 and 16 are positioned on the strap 12, 12', or 12" and/or the base 62 or 62', when it is said that the walls 14 and 16 extend generally upwards away from the adult's chest for a distance of at least about 2 inches, more preferably a distance of from about 2 inches to about 8 inches, it is meant that walls 14 and 16 extend generally upwards for a distance of at least about 2 inches, more preferably, a distance of about 2 inches to about 8 inches above the structures on which the walls 14 and 16 are resting (i.e., the chest strap and/or the base), as shown in FIG. 1 (wherein the heights 38 and 36 are drawn from the base 62 to the top of the walls 14 and 16).

In other embodiments, as shown in FIG. 9, the sleeping restraint 10 does not include a distinct base but instead includes a strap 12 having a variable width 74, as shown in FIG. 9. For example, as shown in FIG. 9, the strap 12 may include a narrow portion having a width of, for example, from about 0.5 to about 2 inches and a wide portion having a width of, for example, from about 6 inches to about 12 inches.

The sleeping restraint 10 can be used in a method for securing a child 46 to an adult 26. For example, the sleeping restraint 10 can be used to secure a child 46 to an adult 26 lying in a substantially horizontal position on, for example, a floor, a bed or a couch. However, it will be appreciated that such surfaces are merely exemplary.

In an embodiment, a method for using the sleeping restraint 10 to secure a child 46 to an adult 26 includes:

A) at least partially encircling the at least one chest strap 12 or 12' and 12" around the chest of the adult 26;

B) positioning the adult 26 in a substantially horizontal position such that the adult 26 is lying on the adult's back 34;

C) positioning the first and second child restraining walls 14 and 16 on the anterior portion 66 of the adult's chest such that the first and second restraining walls 14 and 16 extend vertically upward away from the adult's chest and longitudinally along the length of the adult 26; and D) positioning a child 46 of about 3 years of age or younger between the first and second restraining walls 14 and 16.

Steps A-D described above can be performed in any suitable order or simultaneously. For example, Step C can be performed simultaneously with Step A, by encircling the chest strap 12 or 12' and 12" around the adult's chest such that the first and second child restraining walls 14 and 16, which extend away from the chest strap 12, are positioned on the anterior portion 66 of the adult's chest and extend vertically upward away from the adult's chest and longitudinally along the length of the adult 26.

In certain embodiments, the method further includes attaching the first restraining strap 18 to the second child restraining wall 16. Alternatively, as mentioned, the sleeping restraint 10 can further comprise a second restraining strap 59, in which case the method can further include attaching the first restraining strap 18 to the second restraining strap 59.

Preferably, a child 46 is positioned between the first and second child restraining walls 14 and 16 such that the longitudinal axis 68 of the child 46 is substantially parallel to the longitudinal axis 70 of the adult 26. As known to those of ordinary skill, the longitudinal axis of the human body is a straight line that runs through the body's center of gravity and extends through the head and the space between the feet of the human. It is also preferred that the first and second child restraining walls 14 and 16 are generally cylindrical in shape and the longitudinal axes 52 and 54 of the first and second child restraining walls 14 and 16 are substantially parallel to the longitudinal axis 70 of the adult 26 when the adult 26 is lying on his back 34 and the chest strap 12 is encircled around the chest of the adult 26.

Preferably, as shown in FIGS. 1-10, the opening between the first and second child restraining walls 14 and 16 is uninterrupted, as the sleeping restraint 10 is generally designed to be worn by an adult who is in a substantially horizontal position.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention, as defined and limited solely by the following claims.

What is claimed is:

1. A sleeping restraint for a child, comprising:

a) a chest strap for at least partially encircling an adult's chest, the chest strap having a strap length and first and second strap ends;

b) a connector for joining the first and second strap ends together after the chest strap is placed around the adult's chest;

c) first and second child restraining walls extending away from the chest strap so that when the adult is lying on the adult's back, the chest strap is at least partially encircling the adult's chest and the first and second child restraining walls are positioned on the anterior portion of the adult's chest, the walls extend generally upwards away from the adult's chest, the walls being spaced along the length of the chest strap, the walls each having a wall length transverse to the strap length, the first child restraining wall having an interior side facing the second child restraining wall and an exterior side opposite of the interior side, the second child restraining wall having an interior side facing the first child restraining wall and an exterior side opposite of the interior side;

d) a first restraining strap for restraining a child in place on the adult's chest between the walls when the adult is lying on the adult's back, the first restraining strap attached to the interior side of the first restraining wall; and e) an alarm system comprising an alarm, a power source configured to power the alarm system, a memory, a sensor configured to determine the orientation of the sleeping restraint and a processor configured to trigger the alarm when the sensor senses that the sleeping restraint occupies a dangerous orientation.

2. The sleeping restraint of claim 1, wherein the sleeping restraint further comprises a second restraining strap attached to the interior side of the second child restraining wall.

3. The sleeping restraint of claim 2, wherein the sleeping restraint comprises a three prong harness, the first prong of the harness comprising the first restraining strap, the second prong of the harness comprising the second restraining strap and the third prong comprising a third restraining strap attached to the chest strap.

4. The sleeping restraint of claim 1, wherein the first and second restraining walls each have a wall width parallel to the strap length and a wall height perpendicular to the wall width and the wall length, and further wherein the wall heights of the first and second restraining walls are at least about 8 inches.

5. The sleeping restraint of claim 4, wherein the first restraining wall has a base attached to the chest strap and a peak opposite the base, and the first restraining strap is attached to the interior side of the first restraining wall closer to the base than to the peak.

6. The sleeping restraint of claim 5, wherein the peak of the first restraining wall is configured to withstand a force of at least about 500 Newtons.

7. The sleeping restraint of claim 1 wherein the first and second restraining walls are each comprised of a plastic frame and a substantially hollow interior.

8. The sleeping restraint of claim 1, wherein the sensor is an accelerometer configured to determine the x, y, and z orientation of the sleeping restraint.

9. The sleeping restraint of claim 1, wherein the strap length of the chest strap is from about 25 inches to about 55 inches.

10. The sleeping restraint of claim 1, wherein the chest strap further comprises a pocket.

11. A sleeping restraint for a child, comprising:

a) a chest strap for at least partially encircling an adult's chest, the chest strap having a strap length and first and second strap ends;

b) a connector for joining the first and second strap ends together after the chest strap is placed around the adult's chest;

c) first and second child restraining walls extending away from the chest strap so that when the adult is lying on the adult's back, the chest strap is at least partially encircling the adult's chest and the first and second child restraining walls are positioned on the anterior portion of the adult's chest, the walls extend generally upwards away from the adult's chest, the walls being spaced along the length of the chest strap, the walls each having a wall length transverse to the strap length, the first child restraining wall having an interior side facing the second child restraining wall and an exterior side opposite of the interior side, the second child restraining wall having an interior side facing the first child restraining wall and an exterior side opposite of the interior side;

d) a first restraining strap for restraining a child in place on the adult's chest between the walls when the adult is lying on the adult's back, the first restraining strap attached to the interior side of the first restraining wall; and e) a rod configured to adjust the distance between the first and second restraining walls.

12. A method for securing a child to an adult using a sleeping restraint, the method comprising the steps of:

a) providing a sleeping restraint comprising:

i) a chest strap for at least partially encircling an adult's chest, the chest strap having a strap length and first and second strap ends;

ii) a connector for joining the first and second strap ends together after the chest strap is placed around the adult's chest;

iii) first and second child restraining walls extending away from the chest strap so that when the adult is lying on the adult's back, the chest strap is at least partially encircling the adult's chest and the first and second child restraining walls are positioned on the anterior portion of the adult's chest, the walls extend generally upwards away from the adult's chest, the walls being spaced along the length of the chest strap, the walls each having a wall length transverse to the strap length, the first child restraining wall having an interior side facing the second child restraining wall and an exterior side opposite of the interior side, the second child restraining wall having an interior side facing the first child restraining wall and an exterior side opposite of the interior side; and iv) a first restraining strap for restraining a child in place on the adult's chest between the walls when the adult is lying on the adult's back, the first restraining strap attached to the interior side of the first restraining wall;

b) at least partially encircling the chest strap around the chest of the adult;

c) positioning the first and second child restraining walls on the anterior portion of the adult's chest such that the first and second child restraining walls extend vertically upward away from the adult's chest and longitudinally along the length of the adult; and d) positioning a child of about 3 years of age or younger between the first and second child restraining walls.

13. The method of claim 12, wherein the second child restraining wall further comprises a second restraining strap, the second restraining strap attached to the interior side of the second restraining wall, and the method further comprises the step of:

e) attaching the first restraining strap to the second restraining strap.

14. The method of claim 12, wherein the child is positioned between the first and second child restraining walls such that the longitudinal axis of the child is substantially parallel to the longitudinal axis of the adult.

15. The method of claim 12 wherein the sleeping restraint further comprises an alarm system, the alarm system comprising an alarm, a power source configured to power the alarm system, a memory, a sensor configured to determine the orientation of the sleeping restraint and a processor configured to trigger the alarm when the sensor senses that the sleeping restraint occupies a dangerous orientation.

16. The method of claim 15, wherein the sensor is an accelerometer configured to determine the x, y, and z orientation of the sleeping restraint.

17. The method of claim 12, wherein the first and second restraining walls each have a wall width parallel to the strap length and a wall height perpendicular to the wall width and the wall length, and further wherein the wall heights of the first and second restraining walls are at least about 8 inches.

18. The method of claim 17, wherein the first restraining wall has a base attached to the chest strap and a peak opposite the base, and the first restraining strap is attached to the interior side of the first restraining wall closer to the base than to the peak.

19. The method of claim 12, wherein the peak of the first restraining wall is configured to withstand a force of at least about 500 Newtons.

* * * * *